US005682142A

United States Patent [19]

Loosmore et al.

[11] Patent Number: 5,682,142

[45] Date of Patent: Oct. 28, 1997

[54] ELECTRONIC CONTROL SYSTEM/ NETWORK

[75] Inventors: N. Bert Loosmore; Kenneth Ehrman; Bruce Jagid, all of New York, N.Y.

[73] Assignee: ID Systems Inc., New York, N.Y.

[21] Appl. No.: 282,978

[22] Filed: Jul. 29, 1994

[51] Int. Cl.[6] ..... G08B 13/14

[52] U.S. Cl. ..... 340/572; 235/385; 340/439; 340/539; 340/573; 340/574; 340/584; 340/825.44; 340/825.49; 342/44; 364/403; 455/88

[58] Field of Search ..... 340/572, 573, 340/574, 539, 584, 825.49, 825.44, 825.31–825.34; 342/44, 450; 364/403; 235/385, 382; 382/124; 379/37–38; 455/88, 49.1

[56] References Cited

U.S. PATENT DOCUMENTS

| | | | |
|---|---|---|---|
| 3,705,976 | 12/1972 | Platzman | 235/384 |
| 4,303,904 | 12/1981 | Chasek | 235/384 |
| 4,338,587 | 7/1982 | Chiapetti | 340/539 X |
| 4,438,491 | 3/1984 | Constant | 395/286 |
| 4,549,264 | 10/1985 | Carroll et al. | 340/539 X |
| 4,603,390 | 7/1986 | Mehdipour et al. | 235/384 X |
| 4,656,463 | 4/1987 | Anders et al. | 340/572 |
| 4,688,026 | 8/1987 | Scribner et al. | 340/572 |
| 4,908,500 | 3/1990 | Baumberger | 235/384 |
| 4,937,581 | 6/1990 | Baldwin et al. | 342/44 |
| 5,075,670 | 12/1991 | Bower et al. | 340/573 |
| 5,086,389 | 2/1992 | Hassett et al. | 235/384 X |
| 5,089,974 | 2/1992 | Demeyer et al. | 364/492 |
| 5,101,200 | 3/1992 | Swett | 340/937 |
| 5,144,553 | 9/1992 | Hassett et al. | 235/384 X |
| 5,151,684 | 9/1992 | Johnsen | 340/572 |
| 5,166,872 | 11/1992 | Weaver et al. | 364/133 |
| 5,192,954 | 3/1993 | Brockelsby et al. | 342/42 |
| 5,204,670 | 4/1993 | Stinton | 340/573 X |
| 5,204,675 | 4/1993 | Sekine | 340/933 |
| 5,218,344 | 6/1993 | Ricketts | 340/573 |
| 5,253,162 | 10/1993 | Hassett et al. | 364/405 |
| 5,257,393 | 10/1993 | Miller | 395/800 |
| 5,281,859 | 1/1994 | Crane | 307/139 |
| 5,287,353 | 2/1994 | Buda et al. | 370/85.1 |
| 5,295,244 | 3/1994 | Dev et al. | 395/161 |
| 5,303,343 | 4/1994 | Ohya et al. | 395/200.13 |
| 5,327,144 | 7/1994 | Stilp et al. | 342/387 |
| 5,396,215 | 3/1995 | Hinkle | 340/573 X |
| 5,426,425 | 6/1995 | Conrad et al. | 340/825.49 |

*Primary Examiner*—Thomas Mullen
*Attorney, Agent, or Firm*—Israel Nissenbaum

[57] ABSTRACT

A network system of programmable, identification, locating, monitoring and processing fixed position (FPN) and movable tag nodes, which provides direct inter-node communication capability without a central processor. The individual nodes include microprocessor elements, pre-programmed to recognize external environmental conditions and to logically act on the basis of recognized condition parameters, and where appropriate, to communicate with other nodes for network action. Each node comprises an IC having three independent processors which share a common memory and control circuitry but with separate sets of registers. A first processor (CPU) provides media access control and communication between the nodes and includes transceiver elements for receiving and transmitting information. A second processor is the application CPU which runs code written for the particular use, as well as the overall operating system, which is provided with direct linkage to interfacing input and output, and the like, for initial processing based on environmental conditions, as preprogrammed. The third processor, a network CPU, links the applications CPU with the communication CPU, and handles network variable processing, addressing, transaction processing, authentication, network management, etc. The nodes provide an independently operable overall network, in a defined area of operation, capable of location identification, logical control of preprogrammed environmental conditions and logical interaction with external inquiries for transactional operations.

43 Claims, 3 Drawing Sheets

ELECTRONIC CONTROL SYSTEM/ NETWORK

FIELD OF THE INVENTION

This invention relates to systems for object or person identification and location, particularly systems used for employee and material tracking purposes.

BACKGROUND OF THE INVENTION

While many systems have been developed and patented for object and people identification and location, those systems have only gone so far as to allow data to be read from an encoded identification tag or for data to be programed on the tag (read-write mode), but only in response to interrogation by a reader. Additionally, these systems have almost invariably required the use of a centralized database or centralized processor. Examples of such systems include Electronic Identification System (U.S. Pat. Nos. 4,937,581 and 5,132,687) and Portable Field-programmable Detection Microchip (U.S. Pat. No. 5,218,343). Other identification methods have been developed describing the protocol and therefore method for identifying tags, such as Electronic Identification Tag Interrogation Method (U.S. Pat. No. 5,266,925). All of these tags have essentially been memory storage units with limited responsive capability. They have not been able to operate or react independently, based on environmental conditions, in any cognitive logical manner. Furthermore, even in network arrays there has been no interactive sharing of information between tags, or system decisional operation except through a central processing unit.

SUMMARY OF THE INVENTION

It is an object of the present invention to provide a network of programmable nodes with each having the ability to respond to specific preprogrammed external environmental conditions and to communicate with other nodes in the network by sending unrequested messages, requesting information, or alerting the system of a particular condition.

It is a further object of the present invention to provide each node in the network with a microprocessor and firmware giving the node the ability to make decisions independent of a central processing unit.

It is another object of the present invention to utilize the decision making capabilities of each node to determine the appropriate distance for each transmission in accordance with the context of the message.

It is a still further object of the present invention to utilize the network for object monitoring and location including identification in various applications.

It is yet another object of the present invention to provide a network for monitoring various parameters including external conditions.

These and other objects, features and advantages of the present invention will become more evident from the following discussion and drawings in which:

SHORT DESCRIPTION OF THE DRAWINGS

DETAILED DESCRIPTION OF THE INVENTION

Figure 1:
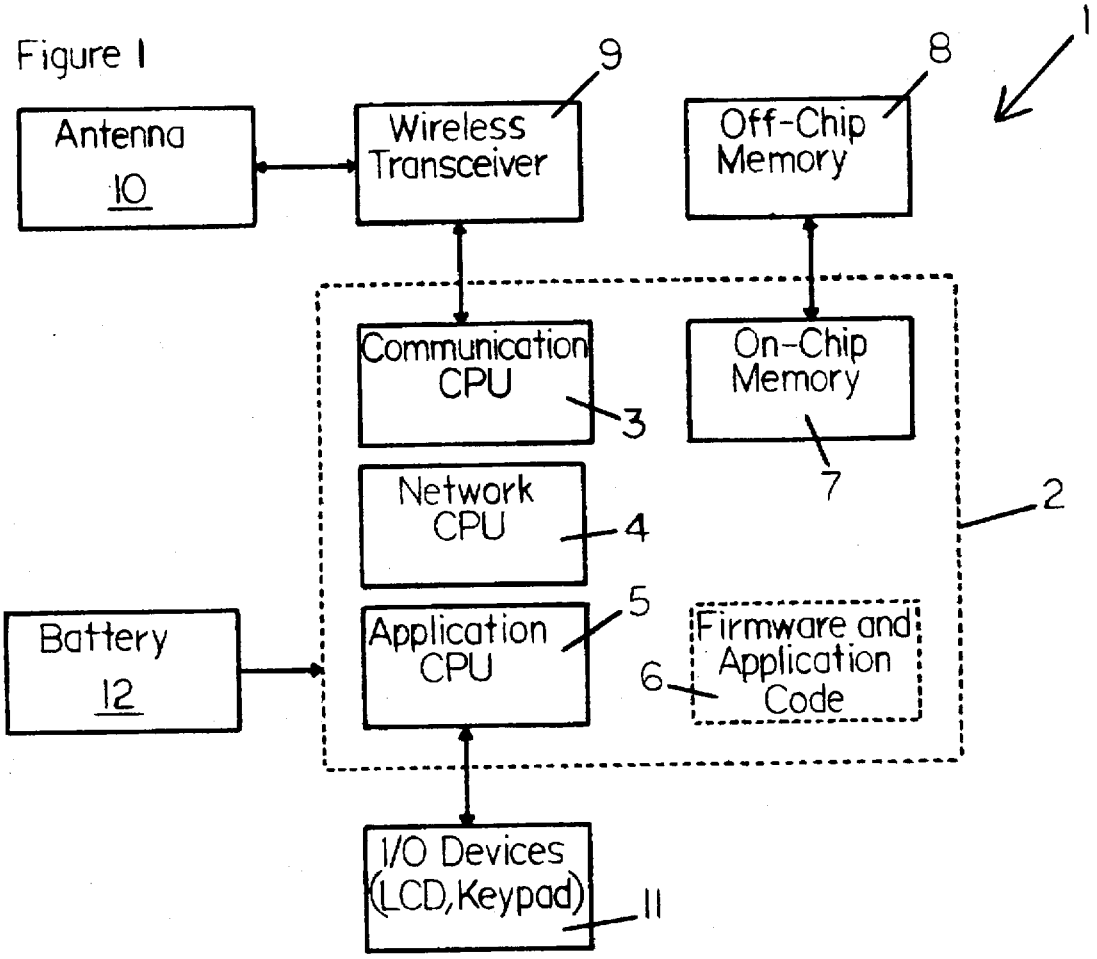
FIG. 1 is a block diagram illustrating the node tag components.

Generally the present invention comprises a method for location and identification of objects and people, the monitoring thereof, and of system relevant parameters under situation conditions, and a method for controlling these situations. The present invention further comprises a standalone, parameter monitoring and evaluation system and a location and identification control system comprising two or more active operation nodes, with at least one programmable, movable identification and processing tag node or at least one programmable fixed position node (FPN). The FPN's are in known fixed positions and the tag nodes are movable, relative thereto. The relation between the fixed and movable nodes (i.e., the movable tag node relative in proximity to one or more fixed nodes) provides the location function. All nodes are initially provided with identification coding indicating where each node will be installed and who or what it is monitoring. The movable tag node is also programmed, where applicable, to monitor, store, change, and/or process environmental conditions in its varying locations.

The nodes each comprise means for direct inter-node communication and means for decision making capability, without a central processor. The tag nodes further comprise means for responsive communication to other tag nodes or an FPN via wireless communications.

The individual nodes (both movable and fixed) include an integral power source, such as a long term battery for the movable nodes and a hard wired power source for the fixed nodes. The nodes further comprise microprocessor and memory elements which are pre-programmed, where appropriate to the application, to recognize external environmental conditions and inquiries and to logically act on the basis of recognized condition parameters (received via i/o means), and means to communicate with other nodes for total or partial network action, e.g. via transceiver means. The distance of the communication, via wireless transceiver, is determined by the microprocessor means and is related to the message being transmitted. The external environmental conditions information is attained via wireless inquiry through communication interaction from other nodes as well as from attached i/o means.

Each tag node and FPN is identified with a unique ID number by which it is uniquely addressed and identified. Each node comprises an integrated circuit, operatively controlled thereby, preferably having at least three independent microprocessors which share a common memory and control circuitry but with separate sets of registers.

In the integrated circuit, in the preferred embodiment, a first microprocessor or communication CPU provides media access control and includes linkage to transceiver means for receiving and transmitting information between the nodes (such as between the tag and an FPN, inter-tag, or FPN to FPN).

A second microprocessor is the application CPU which runs code written for the node's particular use. This second microprocessor is provided with direct linkage to i/o means for initial processing based on environmental conditions, as preprogrammed, and for human interaction for information entry and receipt. Examples of input means include keypad, condition sensors such as a temperature gauge, etc. Examples of output means include LCD display, sound alarms, and the like.

The third microprocessor, a network CPU, links the applications CPU with the communication CPU, and handles network variable processing, addressing, transaction processing, authentication, network management and the like.

The microprocessors, with additional digital circuitry and i/o and communication hardware, with particular application configuration and power source, provide components of an independently operable network in a defined area of operation capable of location identification, monitoring and logical control of preprogrammed environmental conditions and logical interaction with external inquiries for transactional operations. Specific applications include employee location within a work site. Other applications include locating doctors and equipment within a hospital, patient monitoring, product and inventory location and production monitoring within a warehouse or factory, automated time and motion studies, cargo transport monitoring and the like, and includes security applications in university settings and in monitoring unauthorized entry in secure locations and monitoring temperature conditions of perishable inventories.

The individual nodes provide intelligent processing function. For example, in employee or personnel location applications, with security control, the tag nodes are programmed with security level parameters to enable the system to determine the proper location for the tags and the wearers thereof. Additionally, the tag nodes retain location information and process profiles of employee work habits and time spent at work or with specific work functions. The tags may be programmed to recognize normal usage patterns and to signal an alarm if such patterns are deviated from. Due to the processing and communication power of the tags and FPN's, functions which have always required the use of a centralized processor can be attained.

The present invention further comprises specific utilization of the network system for application in hospital, factory and warehouse environments, a university setting, as well as in cargo transport monitoring.

The system is configured to fit the needs of a particular monitoring or identification application with the use of appropriate firmware to run on the second microprocessor (application CPU) and input/output devices attached to the microprocessor and appropriate network configuration to run on the third microprocessor (network CPU).

The communication and interconnection (wireless or otherwise) between more than one FPN and/or tag node creates a network. Three microprocessors, combined into one integrated circuit, as described above, are available and specifically include the Neuron® 3150 integrated circuit, manufactured by Motorola and Toshiba, which is preferred for use in each tag node and FPN. In these integrated circuits, the first microprocessor (communication CPU, as described above) handles the media access algorithm (predictive p-persistent CSMA). The second microprocessor handles the application code. The final microprocessor handles network variable processing and network management.

In these preferred integrated circuits, with multiple microprocessors, each integrated circuit contains a unique 48 bit ID, stored in read-only memory, which facilitates network addressing and identification. In accordance with the present invention, a tag node receives a message from an FPN or other tag node which contains the ID number of the node, and therefore returns an intelligently directed response only to the sending node. Messages between different tag nodes and FPN's may be effected by using for example Acknowledged service (the destination node generates and sends an acknowledgement message back to the source node that the message was received), Request/Response (with data being sent from a source to a destination node, which destination node sends data back with a response). Unacknowledged (a message between nodes wherein no response is expected or required). Most applications use Acknowledged service which allows the sending node to know that its message was received. Additionally, certain messages, such as those alerting security of an intrusion or break-in may be given priority which, under the above protocol, grants them first access to the network as it becomes available. It is preferred that total memory (RAM, ROM, EEPROM, etc.) be at least 64K in order to allow sufficient application code and data storage.

To provide an additional level of safety, certain messages may be sent using an authentication-key algorithm. This allows those messages which, for example, try to change a tag's, and therefore employees' security level, to be confirmed before any change is made. A further function of the system is the existence of network variables, which allows variables from one node (tag or FPN) to be specifically bound to another variable of another node.

In addition to the microprocessors, each node (tag or FPN) contains a power source (for tag nodes it is preferable that the power source be mobile, such as a battery or solar cell), memory, a transceiver (transmitter-receiver) and certain input/output (I/O) devices. The transceiver provides a communications link between the node and the rest of the network. Tags communicate with FPN's or other tags by using a wireless transceiver in order to provide non-contact communications. This allows objects and people to become part of the network without intervention, by only being within a "capture zone", a range suitable for communication. The "capture zone" distance is varied based on the power output of the transceiver and antenna placement or type. The "capture zone" defines the identity of the FPN for relative location of the tag node. Suitable wireless transceivers are available from Motorola (R-net), Utilicom, and Telxon. FPN's are interconnected using a twisted pair wiring scheme, a powerline, wireless, link power solution, or the like. I/O devices provide a human interface to the tag or FPN's, such as a keypad and display, or may provide connections to other sensors and actuators the tag or FPN is adapted to monitor.

In operation, communication between separate nodes is based upon a message transfer, as exemplified by the following interchange:

In the sending node, the applications CPU decides (based on timers, i/o inputs, etc.) that it needs to send a message out over the network to communicate certain information to other nodes, as a "network variable", which the application processor updates. When updated (which occurs in the memory shared between the network and application CPU's, i.e., an application buffer) the variable is transferred by the network CPU to a network buffer. The network CPU then modifies the memory to include other information such as address (to and from), and any special handling information such as authentication. Addresses of the nodes of the system, to which the specific messages are being sent, are stored in memory such as at installation time. The communication CPU monitors network communications until the communication channel is clear, at which time it transmits the message out over the network through the transceiver and via media such as twisted pair wires, radio frequency, etc. The algorithm used to determine when a message is being sent is predictive p-persistent CSMA.

The message travels along the network until it is attenuated by the media to the point that is unrecognizable as a valid message. Only those nodes that are within the defined reachable network area (i.e. based on the characteristics of the transceiver) will receive a valid message.

At the receiving node the message is received via its transceiver, where the message is transmitted to the communication CPU. The communication CPU makes sure that the received message contains a valid format. If so, it is stored in its network buffer. The network CPU, knowing that a message has been received, decodes the message to check whether the message was intended for that node. If not, it is discarded. If it was, additional checking or processing is performed, if necessary, e.g. authentication and acknowledgment. The new value of the network variable is extracted and passed via the application buffer back to the application program of the application CPU. The program then uses the new value in accordance with parameters of the specific application.

With respect to all of the nodes, there is a range of operation or capture zone wherein a tag in such zone can communicate with other nodes. The range varies with the particular application, as well as the type of message being sent. For example, in an employee monitoring application, a capture zone for an FPN that is monitoring employee security levels is limited to an entrance or a single room. Additionally, if the FPN is looking for employees that wish to enter the door, it sends out a seek-tag message to reach the only entranceway of the door. If the FPN is attempting to determine the names of all employees in the room, the message would be sent out a distance that covers the entire room. For optimal operation, capture zones of various tags or FPN's, of usual circular configuration, may be slightly overlapped to insure complete areal coverage by at least one node. Receipt of location feedback from two or more FPN's, automatically more narrowly locates the tag, in the overlapping area between the respective capture zones.

In addition, in some applications, it may be desired to connect a human interface node to the network. In this case, a Personal Computer or the like may be attached to the network to view and change information on the network which it is authorized to access and with which it is capable of achieving network communications.

With more specificity, in an employee monitoring and access control application, the system operation involved is preferably as follows:

EXAMPLE 1

Security and Timecard Application

Employees carry or wear tags which are programmed in memory with information which includes employee identification means, specifically the employee's name, and employee ID number. For time-keeping purposes, individual tags provide employee time tracking means by keeping track of employee's time in, time out and the amount of time at the employment site, i.e., total time worked (presumably). This function also serves to provide a means for locating specific employees. Further, for security applications, tags contain the employee's security level, an electronically stored version of the employee's thumbprint, a security PIN number, etc. Security clearance, as used in this context, either specifically details or determines which doors (and therefore areas) the employee can enter, at which times and dates.

FPN's are placed throughout the work place, with preferably at least one per room or area to be monitored, as well as along hallways, and at entry and exit locations, included gated employee parking lots. Nodes at the entry and exit locations constantly send out "seek-tag" messages. Tags receive this message and respond with their security level, in order to determine whether the employee is authorized to enter. When validated, which is achieved either by correct security levels on the tag or by the use of a PIN, the FPN output means causes the door to open for entry. However, should a group of employees enter at a single time with a single validation to open the door, all tags are still verified. A security alert is generated if any of the tags indicates that the employee is not authorized for entry. Actual monitoring of tag use can be checked by employees, where employees must ensure that no one enters a door without a tag or by coupling the FPN to a motion sensor input device to sense an entry without a corresponding tag message.

As the tag (and therefore employee) is granted access to enter the building, the tag receives and stores messages from the FPN and in turn stores entry time and location in its memory. As the employee leaves the premises, an FPN located above the exit doorway, which also constantly sends out "seek-tag" messages, contacts the exiting tag with exiting time and date information. The tag calculates the total time worked (i.e., defined as total time within the workplace) and then passes the calculated value to the FPN. This information is stored and then used for payroll or other employee evaluation purposes.

Interior doors and areas are held secure through the same methodology as the exterior passageways. Tags can be programmed to have different security levels based on time of day or based on usage. For high security applications, the tags have employee photographs laminated to the case for visual inspection. In addition, unique biometric information, such as an image of the employee's thumbprint, is stored within the tag's memory. Upon an entry request, the employee uses a thumbprint reader to scan his or her thumb. The image is processed and compared to the stored image on the tag. A match causes the entry door to open. If not, security is alerted. In addition, other biometric information can be stored on the tag, such as retinal scan, etc. As a backup, the tag is loaded with personal data of the employee, and randomly presented questions regarding such data are put to the employee and answers are entered via a local keyboard. A correct answer permits entry.

To continually control building access, tags are initially programmed with termination dates. On a monthly basis, tags consult a validation node, a node which stores current security validation levels, to compare current employees and their clearances. Tags of terminated employees are deactivated. Subcontractors and visitors are provided with tags with short term validity of appropriate clearance. When modifications are made to a tag's security level, which can be upgraded or downgraded as appropriate, a message is sent out to all FPN's to locate the tag. Should the tag not be present in the premises for validation or different revalidation, the new parameters are stored in memory of each entry FPN for a month or until the tag is brought within appropriate range and is modified or deactivated. These changes are then updated in the validation node. If the monthly time limit expires, tags are automatically deactivated and can then be reactivated by the security office and the changes made at that time. Because of the communication link between the tags, the FPN's, and the validation node, changes to tags are made automatically without the necessity for collection and return of tags.

The wireless transceiver allows employees not to remove ID badges from their person so that there is no need for swiping of cards with recordation of entry and exit times. Multiple swipes by groups of authorized employees are therefore also not required, (i.e., if multiple employees enter a doorway simultaneously, they are not ALL required to individually actively validate their badges). With recordation of movement of each employee, an employee's location is known at all times for monitoring and two-way paging.

Since each tag is encoded with a unique identification marker, such as employee name or employee ID number, the tag can be utilized to locate an employee or a group of employees within the work area (or a doctor within a hospital, etc.). An FPN is accessed through its i/o port with entered employee identification (name or ID number) and generates a locate message. The locate message is transmitted to all of the FPN's which then makes inquiry of all of the tags in the capture zone of the relevant areas. The located tag acknowledges receipt of the message with an indication of location to the sending FPN. An audible tone on the employee tag alerts the wearer regarding the paging and/or a message on an LCD view screen displays a personalized message. The proximate FPN creates a new message indicating that the tag in question is within its capture zone, and transmits it back to the initial FPN, advising the inquirer where the employee or other personnel are located. Responses can be similarly sent to the original pager or to any other relevant person.

A human interface(HI) node is able to poll any node on the network that is reachable from the human interface node, and retrieve any information stored in that node's memory. An example of this capability is the following: software running on such an HI node allows managers to view their employee's locations. It additionally allows a manager to compile statistics of their employees' work habits. A validation node, an example HI node, contains all security clearances and a manager or other security personnel can view and change this node at any time from such an HI node. A manager therefore, by accessing the network, has a list or his/her employees and their clearances. Additionally, accounting software is contained on an accounting HI node which receives information from the tag nodes to keep track of time worked (based on entry and exit times), which may be accumulated on a weekly/monthly basis. This information is then used for payroll purposes.

The following are further specific examples of utilization of the present invention in the environments of a hospital, manufacturing facility, cargo transport, and a university:

EXAMPLE 2

Hospital

Tag nodes are worn by doctors, patients and other hospital personnel and may also be attached to crucial movable equipment for various functions related to monitoring, identification and location. By tracking the location of each tag, the system provides security functions allowing only authorized personnel in restricted area and also limits the use and movement of tagged equipment.

Though most patients are in a fixed position (a hospital bed or surrounding environments), patients with a tendency to wander can be monitored. By consistently monitoring doctor and patient location, incoming telephone calls can be directed to the phone nearest the doctor or patient and can also thereby function as a two way paging system. In one embodiment the tags are provided with information inputting keypads to permit information to be remotely transferred to other tags, including the people or equipment to which they are attached, including a specific doctor's patient.

In an emergency situation, patients or nurses activate the tag, such as by a push-button to immediately call the nearest doctor. The system can make this determination by polling the FPN's that are closest to the FPN which receives the distress message. Similarly hospital personnel can locate the nearest equipment, such as an EKG machine by keying in a code for such equipment. A view-screen informs the requester of the nearest location of the machine. Patient history stored in the memory of a tag is immediately available to an attending doctor. Patient prescription information or feeding schedule is similarly available in memory to enhance accuracy and to alert personnel when dosages or meals are missed (a nurse's tag sends confirming messages to a patients tag as a drug or meal is dispensed). Lack of confirming messages cause the patient's tag to sound a warning and the appropriate personnel's tag is notified.

EXAMPLE 3

Manufacturing Facility

While the system can be utilized as a time card system, two-way paging device, and employee tracking means, it can also be used as a production control and cost accounting tool, with the tags worn by the employees automatically keeping track of their entry and exit times and tracking their use on specific machinery or on certain jobs, i.e. productivity. Tags on inventory and work orders throughout the production facility monitor usage, inform planners of quantities and locations, and monitor jobs throughout the production process.

The employee tag is used for measurement of employee's use of machinery for output and time to evaluate employee performance and track labor costs (i.e. which employee worked on which workorder for what amount of time). In this mode, the tags communicate with FPN's attached to the output of the machinery. The machinery, which identifies the employee using it, is automatically customized to the user's needs, such as for accommodation of handicapped personnel, or customization for a particular work order's needs.

Tags of specialized dimensions with imbedded keypads are attached to work orders and routed to appropriate work stations to monitor stages of the production processes via i/o means, yield data is entered onto the tag, for comparison to formulas perfected by industrial engineers to optimize internal and external quality, which are stored on the tag. This data can be used to determine the routing of a work order. Failure rates or large deviations indicate a process which is out of control and a supervisor is immediately notified by the tag via the previously described communication link or by direct inquiry of the tag.

By monitoring the time spent at various workstations, as well as by storing information regarding the specific employees who worked on a work order, costs can be assessed and quickly and accurately associated with a particular work order. This is accomplished when tags associated with employees communicate with tags associated with work orders which both communicate with FPN's associated with machinery. In addition, the status of a workorder can be evaluated real-time.

The tag is also useful in monitoring inventory location, quantity, age and environmental conditions. Location of inventory is accomplished by methods similar to those previously described with respect to employee location. The tags are initially loaded with product, source, or other identification information and a summation of all the tag identifications serves to identify particular items, and also provides information regarding inventory quantity. The tags are initially encoded with a date which is later utilized in determining age of the particular item of inventory, thereby facilitating use of the FIFO method. Appropriate gauges attached to the tag i/o means provide proximate environmental conditions, such as the temperature at which the products are being stored or to which they have been subjected during storage. When inventory is issued, the data is entered directly on the appropriate tag with the parts. With pre-determined parameters, when inventories fall below set levels, the system alerts the tag of a purchasing agent, to replenish stock of the identified item.

When a production line goes down, or when urgent issues arise, the two-way paging ability of the tag significantly increases efficiency.

EXAMPLE 4

Cargo Transport Monitoring

With cargo transport, tags are attached to trains, trucks or containers with stored information regarding cargo type, origin, time from destination, current location, etc., thereby creating an electronic bill of lading. The tags then communicate location and status at set intervals or with proximity location to roadside or trackside fixed location nodes. The tags can also be programmed to provide real-time fuel consumption information, refrigerator car monitoring and the like.

Registration information is stored on tags for trucks for communication with weigh-in-motion sensors to store weight, etc. Highway, bridge and tunnel authorities with FPN's can read the relevant information from the trucks without the necessity for stopping the trucks. If desired, the tags input lines on trucks or other vehicles, can be linked to speedometers, odometers, brakes, or fuel gauges, etc., to monitor driver and vehicle performance.

EXAMPLE 5

University Identification and Security Card

In a university or other campus setting, FPN's are distributed throughout the facility to receive alerts from persons wearing tags. When a button on the tag is pressed, the FPN's in the area receive the alert signal from the tag and triangulate the area to determine the specific location. The triangulation is accomplished by the FPN which receives the distress signal communicating with those around it to determine which ones have received the message. When the area is pinpointed, the signal is transmitted to a HI node at the closest security center. A return confirmation signal, such as an audible tone on the tag confirms that help is on the way. An additional function that is attained by using the same FPN grid is a "guard-tour" function to ensure that guards reach their sentry points at the scheduled times.

Other uses for the tag include storage of student or employee ID number and university account information. This account information can be used for on-campus purchases, and library transactions, etc. Students can use the tag to monitor and track their spending habits and keep a budget. Unauthorized access will be eliminated by using the authentication algorithms.

The triangulation function, described above can be readily utilized with other applications to specifically locate items or people as required by location input from two or more FPN's. In this aspect it is possible to provide the FPN's with variable communication ranges (based on power output) to permit extension of range to more effectively use the triangulation location, where only one FPN is within the "capture zone".

DETAILED DESCRIPTION OF THE DRAWINGS AND THE PREFERRED EMBODIMENT

Referring first to FIG. 1 there is shown a block diagram of the basic hardware components associated with the tag 1, the control device located on an object, in accordance with the present invention. The tag 1 includes an integrated circuit 2 with its three (3) microprocessors 3, 4, and 5, and their associated firmware 6. Included in the firmware 6 is the general communications protocol and the specific application code and specific network configuration for the particular application. The firmware 6 is stored in both on-chip memory 7 and off-chip memory 8. The integrated circuit 2 is also coupled to the wireless transceiver 9. The wireless transceiver takes a digital signal from the microprocessor and converts it into an electromagnetic signal which is then transmitted via the antenna 10.

Additionally, the antenna 10 receives electromagnetic signals which it passes to the wireless transceiver 9, which then converts these electromagnetic signals to digital signals which are then passed to the integrated circuit 2.

Each tag 1 is powered by a long life battery 12. Depending on the particular application of the system, the integrated circuit 2 will have various input/output (I/O) devices 11 associated with it. These may include sensors and actuators, such as a keypad or display.

Figure 2:
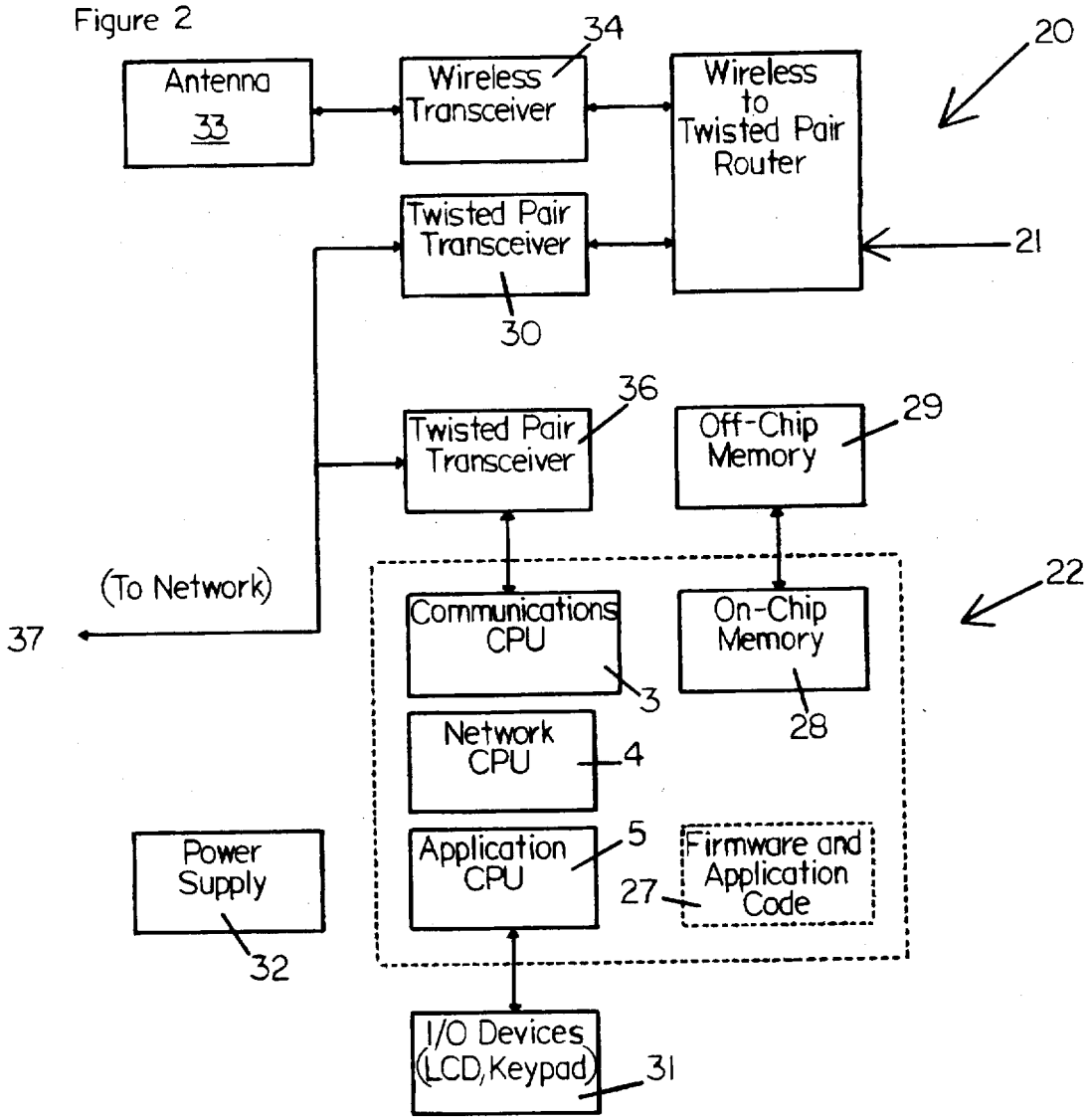
FIG. 2 is a block diagram illustrating the Fixed Position Node member components.

FIG. 2 depicts a block diagram of the basic hardware components associated with the FPN 20. The node 20, as defined in the present invention, has two main components: the monitor node 22 and the router hardware 21. The power supply 32 means provides power to both parts of the system. The remainder of the monitor node 22 is identical to the tag node 2 above except that communications occur through a twisted pair transceiver 30 and the firmware 27 is changed to be specific to the particular application. Its specific firmware 27 is stored in on-chip memory 28 and off-chip memory 29. Associated with the integrated circuit may be certain I/O devices 31.

The router hardware 21 translates messages between different media types, in this case between the wireless transceiver of the tag and the twisted pair transceiver 30 of the monitor node 22. Messages leaving the monitor node 22 travel along the network 37 and are received by the twisted pair transceiver 36. This transceiver converts the signal on the network 37 to a digital signal understandable by the router hardware 35. This signal is then modified into a form recognizable by the wireless transceiver 34 and is then propagated to the airwaves via the antenna 33. Similarly, messages received from the tag are eventually placed upon the network 37 after being translated through the router 21.

Figure 3:
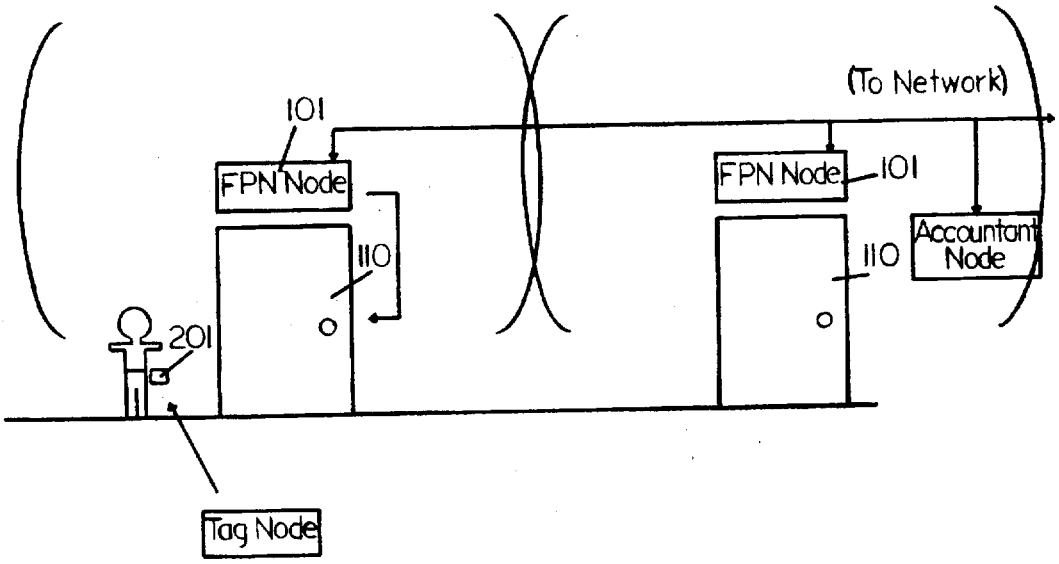
FIG. 3 is a schematic of the placement of tag and Fixed Position Node's (FPN's) for monitoring of objects or people and for identification, location, and other condition evaluation of such information.

As an example of a location and security application, in FIG. 3, an entranceway is fitted with FPN's 101 having a specified range of inquiry, which may overlap with the range of other nodes in the system. As shown, an employee passing through the entranceway, and wearing tag node 201 causes an interrogation conversation between the FPN and the tag regarding security level clearance and employee identity. If authorized, a lock for door 110 is actuated by the node 101 and opens to admit the employee to the specific area and a record is entered on the tag of the time and date of entry. Upon exit from the area, nodes 101 converse with the tag node 201, note the time of exit, and calculate the total time of presence at the work site from entrance data previously written on the tag. The total time is then transmitted, via the FPN, to an accounting node for determination of pay.

Location of an employee within the work site is accomplished by linked FPN's conversing regarding the tags within their ambit of inquiry until the tag in question is located. The location of the tag (and the employee) is transmitted via the network of inquiry tags to the requester.

Similar types of operation are possible with respect to location of doctors, patients and movable medical equipment within a hospital setting; and location of inventory and products within a warehouse or factory setting; and for location of cargo transport of goods, etc. as described above. It is understood however that the above examples of utilization are exemplary of the utilization of the present invention and that changes in the system, inquiry and response protocols, and components of the system are possible without departing from the scope of the present invention as defined in the following claims.

What is claimed is:

1. An identification and location network system comprising two or more nodes, with at least one programmable, location marking and processing, movable tag node, and at least one programmable fixed position node (FPN) for communication with the tag node, for the location, identification and monitoring of said tag node relative to the FPN; said nodes each comprising an integrated circuit with programmable microprocessor means, a unique identification number, transceiver means for receiving and sending information, and memory storage means, and wherein each node further comprises means for direct inter-node communication and means for decision making capable of making decisions by itself, which do not require a central system processor for operation; the tag node further comprising an integral power source and means for communication with an FPN or other tag node with or without interrogation; and said FPN's and tag nodes comprising interface means for interfacing with human or object input and output, wherein said integrated circuit comprises at least three independent microprocessors which share common memory means and control circuitry but with separate sets of registers, wherein a first microprocessor comprises a communication CPU adapted to provide media access control and communication between the nodes and includes linkage to the transceiver means for receiving and transmitting information.

2. The identification and location system of claim 1, wherein a second microprocessor comprises an application CPU, adapted to run code written for at least one of a particular identification and location use, and wherein the second microprocessor is provided with direct linkage to the interface means for initial processing based on environmental conditions, as preprogrammed, and for human interaction for instruction entry.

3. The identification and location system of claim 2, wherein a third microprocessor comprises a network CPU, adapted to link the application CPU with the communication CPU, and wherein said third microprocessor is adapted to handle network variable processing, addressing, transaction processing, authentication, and network management.

4. The identification and location system of claim 3, wherein messages between nodes are effected to allow the sending node to know if its message was received or not, and whether a reply is requested and expected.

5. The identification and location system of claim 3, wherein each node comprises said common memory means comprised of RAM, ROM, and EEPROM, and wherein the memory of said memory means is at least 64K.

6. The identification and location system of claim 1, wherein the tag nodes are programmed with security level parameters to enable the system to determine proper location for the tags and wearers thereof.

7. The identification and location system of claim 6, wherein said tag nodes electronically store versions of the biometric information of the wearers thereof.

8. The identification and location system of claim 6, wherein tag nodes contain personal data of the wearers thereof and said tag nodes present random questions to the wearer, with correct response being required for entry to security protected sites to which the tag nodes are programmed with appropriate security level parameters.

9. The identification and location system of claim 6, wherein the tag nodes comprise means for permitting remote changing of the security level parameters or deactivation thereof, via said transceiver means.

10. The identification and location system of claim 5, wherein locations with security levels have motion detectors to detect entry of anyone not wearing a tag node.

11. The identification and location system of claim 1, wherein the tag nodes are adapted to retain location information and process profiles of employee work habits and time spent at work or with specific work functions.

12. The identification and location system of claim 1, wherein a tag node is adapted to receive a message from another node, which message contains the ID number of the sending node, whereby the receiving node returns an intelligently directed response only to the sending node.

13. The identification and location system of claim 1, wherein said tag nodes further comprise paging means for permitting remote bi-directional paging of the wearer thereof.

14. The identification and location system of claim 13, wherein said paging means comprises an alarm actuating member, which, when activated, causes at least one FPN, in a communication area range, to receive an alarm signal from a tag node having such alarm actuating member thereon.

15. The identification and location system of claim 1, wherein the FPN's are placed throughout an area to be monitored, with potentially overlapping inquiry capture zones, determined by the range of the transceiver means, and at entry and exit locations, wherein FPN's at the entry and exit locations constantly send out "seek-tag" messages, whereby tag nodes which enter the capture zone communicate with the FPN and receive and store messages from the FPN and in turn store entry time and location in the tag node memory storage means, whereby, as the tag node leaves through an exit, an exit FPN is constantly sending out "seek-tag" messages, and thereby contacts the exiting tag node with exiting time and date information, and wherein the tag node calculates the total time worked, defined as the total time the tag node was present within the monitored area.

16. The identification and location system of claim 15, wherein a distance of the capture zone is varied based on the power output of the transceiver means, whereby the capture zone defines the identity of the FPN for relative location of the tag node.

17. A monitoring system comprising the identification and location system of claim 1, wherein a tag node is of specialized dimensions suitable for attachment to a work order in a manufacturing facility, and wherein said tag node is adapted to monitor stages of production processes in said manufacturing facility via interface means, for comparison of the actual stages of production processes to formulas perfected by industrial engineers to optimize internal and external quality of the production processes, which are stored on the tag node, whereby deviations of the actual stages of production processes from the formulas indicate a process which is out of control, and whereby said tag node further comprises means to notify a supervisor of said out of control process.

18. A monitoring system for use in a hospital comprising the identification and location system of claim 1, wherein a tag node is affixed to a specific patient and wherein the health history of the patient is stored in the memory of the tag node for availability to an attending doctor via the interface means thereof.

19. A monitoring system for use in a hospital comprising the identification and location system of claim 1, wherein a tag node is affixed to a specific patient and wherein patient prescription or diet information is stored in the memory storage means of said tag node for availability to an attending physician and wherein said tag node comprises means to alert personnel when dosages or meals are missed.

20. The monitoring system of claim 19, wherein a tag node is affixed to an attending nurse and wherein said nurse's tag node is provided with means to send confirming messages to a patient's tag node as a drug or meal is being administered to said patient to confirm that the drug or meal is appropriate for the patient and wherein said patient's tag node comprises means to sound a warning in the absence of confirmation from the nurse's tag that the drug or meal is appropriate.

21. A monitoring system for use in customizing operation of machinery, comprising the identification and location system of claim 1, wherein an FPN is attached to said machinery, and wherein said tag node identifies the wearer thereof to the FPN and wherein said machinery comprises means to adapt its operation to requirements of said wearer, preprogrammed therein, with said identification information from the FPN.

22. A monitoring system for use in inventory control, comprising the identification and location system of claim 1, with a tag node being used for each item of inventory, wherein the tag nodes are attached to individual items of inventory and wherein the memories of said tag nodes are initially loaded with item identification information relating to the item of inventory to which they are attached.

23. The monitoring system of claim 22 wherein said identification information includes the initial date of introduction of the item to inventory to permit age determination of said item.

24. The monitoring system of claim 22, wherein said tag nodes comprise interface means for measuring environmental conditions for the item of inventory.

25. The monitoring system of claim 24, wherein said interface means comprises a temperature gauge.

26. The monitoring system of claim 22, wherein the system includes an additional node which comprises preprogrammed inventory level parameters, wherein with depletion of inventory and removal of tag nodes, inventory depletion warning means of said FPN are activated.

27. A monitoring system for use in monitoring transport of cargo via transport means, comprising the identification and location system of claim 1 attached to said transport means, with the memory of said tag node containing stored information regarding the cargo, sufficient to provide an electronically stored bill of lading.

28. The monitoring system of claim 27, wherein said tag nodes are programmed and adapted to monitor real-time fuel consumption of said transport means via the interface means.

29. The monitoring system of claim 27, wherein said tag nodes are programmed and adapted to monitor environmental conditions for said cargo via the interface means.

30. The monitoring system of claim 27, wherein said transport means comprises a truck and wherein said tag nodes are programmed and adapted to monitor performance of the truck and a driver thereof via the interface means.

31. A method for the identification and location of an object or person within a designated area, utilizing the network system of claim 1, comprising the steps of:

a. fixedly deploying one or more FPN's at predetermined location points within said designated area, with each FPN having its own said unique identification number, b. providing said object or person with one of said tag nodes having said unique identification number, c. causing said FPN's to send seek messages to said tag node with identification thereof, by said unique identification number, with the tag node having said unique identification number responding to the FPN or nodes closest thereto with an acknowledgment response, and d. identifying the FPN or nodes receiving the acknowledgment response by means of the unique identification number or numbers thereof, thereby locating the tag node and object or person having said tag node relative to the identified FPN or nodes.

32. The method of claim 31, wherein the person is an employee and the designated area is a workplace for the employee.

33. The method of claim 31, wherein the area is a workplace and wherein FPN's are located at an exit and an entrance of said workplace whereby exit and entry of the tag node is noted and stored in said memory storage means of said tag node with instructions from an FPN in communication therewith, said FPN further comprising clock/calendar means to relate said exit and entry to a specific time, and wherein the stored information of said exit and entry times is processed by said microprocessor means to calculate the cumulated time of said tag node being present in the workplace.

34. The method of claim 33, wherein said cumulated time is transmitted to accounting means for payroll determination for the employee having said tag node.

35. The method of claim 31, wherein the person is a doctor and the designated area is a hospital.

36. The method of claim 31, wherein the person is a patient and the designated area is a hospital.

37. The method of claim 31, wherein the object is a movable medical device and the designated area is a hospital.

38. The method of claim 31, wherein the object is an item of inventory and the designated area is a warehouse containing a plurality of items of inventory.

39. The method of claim 31, wherein the object is a work order and the designated area is a factory used for production of items with direction from said work order.

40. The method of claim 31, wherein the object comprises items being transported by transport means and said designated area is the route for said transport means.

41. A method for maintaining security control of a designated area utilizing the network system of claim 1, comprising the steps of:

a. programming a security level on said tag node, b. programming a security access level on an FPN in fixed position adjacent an entrance of said designated area, c. causing said FPN to inquire of said tag node regarding the security level programmed thereon, and d. said FPN permitting access to said entrance only if said security level matches or exceeds the security access level.

42. A method for maintaining security in a university or other campus setting, utilizing the network system of claim 1, wherein FPN's are distributed throughout the university to receive alerts from persons wearing tag nodes, and wherein each tag node is provided with an alarm actuating member, which, when activated, causes at least one FPN, in a communication area range, to receive an alarm signal from the tag node, whereby triangulation of an area may be effected to determine the specific location of the tag node providing the activated alarm signal, said triangulation being accomplished by an FPN, which receives the alarm signal, communicating with other FPNs around the communicating FPN, in the communication area range, to determine which of the FPNs in the communication area range have also received the alarm signal.

43. A method for locating a person or object having a tag node thereon, utilizing the network system of claim 1, comprising the steps of:

a. causing the tag node to communicate with two or more FPN's directly, or b. causing the tag node to communicate with one FPN, and causing the one PPN in turn to communicate with one or more other FPN's and the one or more other FPN's communicating with the tag node, whereby the two or more FPN's triangulate a location position, relative to the tag node, for location of the tag node and the person or object having the tag node thereon.

* * * * *